US009416339B2

(12) United States Patent
Bianchetti et al.

(10) Patent No.: US 9,416,339 B2
(45) Date of Patent: Aug. 16, 2016

(54) TREATMENT COMPOSITIONS COMPRISING MICROCAPSULES, PRIMARY OR SECONDARY AMINES, AND FORMALDEHYDE SCAVENGERS

(71) Applicant: The Procter & Gamble Company, Cincinnati, OH (US)

(72) Inventors: Giulia Ottavia Bianchetti, Rome (IT); Jean-Pol Boutique, Gembloux (BE); Hugo Robert Germain Denutte, Hofstade (BE)

(73) Assignee: The Procter & Gamble Company, Cincinnati, OH (US)

( * ) Notice: Subject to any disclaimer, the term of this patent is extended or adjusted under 35 U.S.C. 154(b) by 57 days.

(21) Appl. No.: 14/150,914

(22) Filed: Jan. 9, 2014

(65) Prior Publication Data

US 2014/0201927 A1 Jul. 24, 2014

(30) Foreign Application Priority Data

Jan. 22, 2013 (EP) ..... 13152210

(51) Int. Cl.

| | |
|---|---|
| ***C11D 3/50*** | (2006.01) |
| ***C11D 3/20*** | (2006.01) |
| ***C11D 3/30*** | (2006.01) |
| ***C11D 3/32*** | (2006.01) |
| ***C11D 3/37*** | (2006.01) |
| ***C11D 17/00*** | (2006.01) |

(52) U.S. Cl.

CPC ..... *C11D 3/505* (2013.01); *C11D 3/2044* (2013.01); *C11D 3/2065* (2013.01); *C11D 3/30* (2013.01); *C11D 3/323* (2013.01); *C11D 3/3723* (2013.01); *C11D 17/0039* (2013.01)

(58) Field of Classification Search

CPC ..... C11D 3/505
USPC ..... 510/501
See application file for complete search history.

(56) References Cited

U.S. PATENT DOCUMENTS

| | | | | |
|---|---|---|---|---|
| 2007/0138671 | A1* | 6/2007 | Anastasiou et al. | 264/4.1 |
| 2007/0138674 | A1 | 6/2007 | Anastasiou et al. | |
| 2007/0191246 | A1* | 8/2007 | Sivik | C09B 44/20 510/276 |
| 2008/0118568 | A1* | 5/2008 | Smets et al. | 424/489 |
| 2008/0227576 | A1 | 9/2008 | Besnard et al. | |
| 2008/0227675 | A1* | 9/2008 | Struillou et al. | 510/101 |
| 2010/0008870 | A1* | 1/2010 | Dihora et al. | 424/59 |
| 2010/0029537 | A1 | 2/2010 | Dihora et al. | |
| 2010/0287710 | A1* | 11/2010 | Denutte et al. | 8/137 |

OTHER PUBLICATIONS

European Search Report for Application No. 13152210.4, dated Jun. 13, 2013, containing 5 pages.

* cited by examiner

*Primary Examiner* — John Hardee
(74) *Attorney, Agent, or Firm* — Gregory S. Darley-Emerson; Leonard W. Lewis; Steven W Miller

(57) ABSTRACT

The need for a treatment composition which provides a pleasant odor to a treated situs, particularly one having a long-lasting woody, floral, fruity or citrus character, and which does not discolor over time, is met by formulating the treatment composition with microcapsules comprising a microcapsule wall formed from cross-linked formaldehyde, and a core comprising an aldehyde or ketone containing perfume, in combination with a formaldehyde scavenger which does not complex with the aldehyde and/or ketone and amine, to form complexes that result in discoloration.

17 Claims, No Drawings

TREATMENT COMPOSITIONS COMPRISING MICROCAPSULES, PRIMARY OR SECONDARY AMINES, AND FORMALDEHYDE SCAVENGERS

FIELD OF THE INVENTION

Treatment compositions comprising perfume containing microcapsules and formaldehyde scavengers which do not comprise an activated methylene group, can provide a prolonged odour benefit without exhibiting discoloration.

BACKGROUND OF THE INVENTION

Perfume raw materials, selected from aldehydes, ketones, and mixtures thereof, are typically used to provide woody, floral, fruity or citrus notes to treatment compositions, and to substrates treated by such compositions. They are also highly preferred, since they provide an odour benefit at low concentrations. It is desirable to encapsulate such aldehydes and ketones into microcapsules, in order to provide long lasting, or in-use odour benefits.

Such microcapsules are typically made by cross-linking selected monomers together, in order to form a shell around a core material, which comprises the perfume raw materials to be encapsulated. Formaldehyde is a preferred monomer, in combination with another monomer which is capable of forming a cross-linked polymer network with formaldehyde. However, such microcapsules are known to slowly release free formaldehyde. In addition, residual amounts of formaldehyde typically remain after the microcapsules are formed. As a result, a formaldehyde scavenger is usually added to the treatment composition, to keep the formaldehyde level to within acceptable levels.

It has been found that treatment compositions containing such perfume microcapsules have poor colour stability. Moreover, the microcapsule slurries themselves often also exhibit poor colour stability. Therefore, a need remains for a treatment composition, particularly one that provides a long-lasting woody, floral, fruity or citrus character to the treated substrate, comprising microcapsules, while also having good colour stability.

SUMMARY OF THE INVENTION

The present invention relates to a treatment composition comprising: microcapsules, the microcapsules comprising a microcapsule core and a microcapsule wall which encapsulates the microcapsule core, wherein the microcapsule wall is formed by cross-linking formaldehyde with at least one other monomer; and the microcapsule core comprises a perfume, the perfume comprising a perfume raw material selected from the group consisting of aldehydes, ketones, and mixtures thereof; and a formaldehyde scavenger selected from the group consisting of: urea, pyrogallol, 1,2 hexanediol, and mixtures thereof.

The present invention further relates a unit dose article, comprising such treatment compositions, wherein the treatment composition comprises less than 20% by weight of water, and the treatment composition is enclosed in a water-soluble or dispersible film.

The present invention further relates to the use of a formaldehyde scavenger selected from the group consisting of: urea, pyrogallol, 1,2 hexanediol, and mixtures thereof, for preventing discoloration in a treatment composition comprising microcapsules.

The present invention further relates to a method of providing an extended odour benefit to a situs, by contacting the situs with a treatment composition according to the present invention.

DETAILED DESCRIPTION OF THE INVENTION

The treatment compositions of the present invention have improved colour stability. By encapsulating a perfume composition comprising perfume aldehydes and ketones, in a microcapsule that is formed by cross linking formaldehyde with another monomer, a long lasting perfume note, and in particular, a woody, floral, fruity or citrus note, can be provided by the treatment composition comprising the perfume microcapsules.

It is believed that residual amounts of the perfume raw materials, including the aldehydes and ketones, remain unencapsulated. In addition, due to porosity of the microcapsule walls, the perfume raw materials are able to slowly leak from the microcapsules, thereby increasing the level of unencapsulated aldehydes and ketones that are present in the treatment composition.

In addition, residual levels of free formaldehyde remain after the microcapsule making process and are incorporated thereafter into the treatment composition. Moreover, formaldehyde is also slowly released from the microcapsule walls.

Many of the formaldehyde scavengers that are typically used in microcapsule containing treatment compositions, such as aceoacetamide, acetoacetic acid ethyl ester, and malonamide, comprise an activated methylene group. However, the perfume aldehydes and ketones may form coloured complexes with such formaldehyde scavengers, and primary or secondary amines, altering the composition colour. Similarly, perfume aldehydes and ketones which are added, as part of an unencapsulated perfume, to the treatment composition also complex with the aforementioned formaldehyde scavengers, and primary or secondary amine. The coloured complexes result in an often undesirable change to the original colour of the treatment composition, resulting in discolouration. The present Applicants have found that such discoloration is avoided through the use of urea, pyrogallol, 1,2 hexanediol, and mixtures thereof, as formaldehyde scavengers. It is believed that, since they do not comprise an activated methylene group, they are unable to react with perfume aldehydes and ketones, to form coloured compounds which discolour the treatment composition.

As defined herein, "essentially free of" a component means that the component is present at a level of less that 15%, preferably less 10%, more preferably less than 5%, even more preferably less than 2% by weight of the respective slurry or composition. Most preferably, "essentially free of" a component means that no amount of that component is present in the respective slurry, or composition.

As defined herein, "stable" means that no visible phase separation is observed for a slurry or treatment composition kept at 25° C. for a period of at least two weeks, or at least four weeks, or at least four months, as measured using the Floc Formation Test, described in USPA 2008/0263780 A1. Colour stable means that there is no observable change in colour for a slurry or treatment composition, in comparison to freshly made slurry or treatment composition, when the slurry or treatment composition is kept at 40° C. for a period of at least two weeks, or at least four weeks, or at least four months.

All percentages, ratios and proportions used herein are by weight percent of the respective slurry or composition, unless otherwise specified. All average values are calculated "by weight" of the respective slurry, composition, or components thereof, unless otherwise expressly indicated. All measurements are performed at 25° C. unless otherwise specified.

Unless otherwise noted, all component, slurry, or composition levels are in reference to the active portion of that component, slurry, or composition, and are exclusive of impurities, for example, residual solvents or by-products, which may be present in commercially available sources of such components or compositions.

The Treatment Composition:

The treatment composition comprises microcapsules for providing a long-lasting in-use odour benefit. The microcapsules are typically added to the treatment composition as part of a microcapsule slurry. The treatment composition preferably comprises the microcapsules at a level of from 0.01 wt % to 12.5 wt %, preferably from 0.1 wt % to 2.5 wt %, more preferably from 0.15 wt % to 1 wt % by weight of the treatment composition. The treatment compositions preferably comprise the microcapsules at a level, such that perfume, which is comprised in the microcapsule core, is present in the treatment composition at a level of from 0.01 wt % to 10 wt %, preferably from 0.1 wt % to 2 wt %, more preferably from 0.15 wt % to 0.75 wt % by weight of the treatment composition.

Since the perfume contained within the microcapsules is encapsulated by the microcapsule walls, they do not provide significant odour benefit to the treatment composition itself. As such, an unencapsulated perfume composition is typically added to the treatment composition. When present, the treatment composition typically comprises the unencapsulated perfume at a level of from 0.1% to 5%, more preferably from 0.3% to 3%, even more preferably from 0.6% to 2% by weight of the treatment composition.

In order to have a similar character to the perfume comprised on the microcapsule core, the unencapsulated perfume composition preferably comprises a perfume raw material selected from the group consisting of: an aldehyde, a ketone, and mixtures thereof. Even more preferably, the unencapsulated perfume comprises a perfume raw material selected from the group consisting of: an aldehyde, a ketone, and mixtures thereof, at a level of from 0.1% to 100%, even more preferably from 1% to 50% by weight of the unencapsulated perfume. The aldehydes and ketones comprised in the unencapsulated perfume also do not complex with the formaldehyde scavengers of the present invention, to form complexes that result in discoloration.

Suitable treatment compositions include: products for treating fabrics, including laundry detergent compositions and rinse additives; hard surface cleaners including dishwashing compositions, floor cleaners, and toilet bowl cleaners.

Fabric treatment compositions are particularly preferred. As used herein, "fabric treatment composition" refers to any composition capable of cleaning a fabric, or providing a fabric care benefit, e.g., on clothing, in a domestic washing machine. Such fabric treatment compositions can be selected from the group consisting of: laundry detergent compositions, fabric softening compositions, and combinations thereof. During machine washing of fabrics, laundry detergent compositions are typically added to the wash cycle, while fabric softening compositions are typically added during the rinse cycle.

The composition can be in solid form, such as powders or granules. However, the treatment composition is preferably a fluid treatment composition. As used herein, "fluid treatment composition" refers to any treatment composition comprising a fluid capable of wetting and treating a substrate, such as fabric or hard surface. Fluid treatment compositions are particularly preferred, since they are more readily dispersible, and can more uniformly coat the surface to be treated. Fluid treatment compositions can flow at 25° C., and include compositions that have an almost water like viscosity, but also include "gel" compositions that flow slowly and hold their shape for several seconds or minutes.

A suitable fluid composition can include solids or gases in suitably subdivided form, but the overall composition excludes product forms which are non-fluid overall, such as tablets or granules. The fluid compositions preferably have densities in the range from of 0.9 to 1.3 grams per cubic centimeter, more preferably from 1.00 to 1.10 grams per cubic centimeter, excluding any solid additives but including any bubbles, if present.

The fluid composition may be a dilute or concentrated liquid. Preferably, the fluid composition comprises from 1% to 95% by weight of water and/or non-aminofunctional organic solvent. For concentrated fluid compositions, the composition preferably comprises from 15% to 70%, more preferably from 20% to 50%, most preferably from 25% to 45% by weight of water, non-aminofunctional organic solvent, and mixtures thereof. Alternatively, the treatment composition may be a low water fluid composition. Such low water fluid compositions can comprise less than 20%, preferably less than 15%, more preferably less than 10% by weight of water.

The fluid composition of the present invention may also comprise from 2% to 40%, more preferably from 5% to 25% by weight of a non-aminofunctional organic solvent. Non-aminofunctional organic solvents are organic solvents which contain no amino functional groups. Preferred non-aminofunctional organic solvents include monohydric alcohols, dihydric alcohols, polyhydric alcohols, glycerol, glycols including polyalkylene glycols such as polyethylene glycol, and mixtures thereof. More preferred non-aminofunctional organic solvents include monohydric alcohols, dihydric alcohols, polyhydric alcohols, glycerol, and mixtures thereof. Highly preferred are mixtures of non-aminofunctional organic solvents, especially mixtures of two or more of the following: lower aliphatic alcohols such as ethanol, propanol, butanol, isopropanol; diols such as 1,2-propanediol or 1,3-propanediol; and glycerol. Also preferred are mixtures of propanediol and diethylene glycol. Such mixtures preferably contain no methanol or ethanol.

Preferable non-aminofunctional organic solvents are liquid at ambient temperature and pressure (i.e. 21° C. and 1 atmosphere), and comprise carbon, hydrogen and oxygen. Non-aminofunctional organic solvents may be present when preparing a premix, or in the final fluid composition.

The treatment composition can also be encapsulated in a water soluble film, to form a unit dose article. Such unit dose articles comprise a treatment composition of the present invention, wherein the treatment composition comprises less than 20%, preferably less than 15%, more preferably less than 10% by weight of water, and the treatment composition is enclosed in a water-soluble or dispersible film. Such unit-dose articles can be formed using any means known in the art. Unit dose articles comprising a laundry detergent composition are particularly preferred.

Suitable water soluble pouch materials include polymers, copolymers or derivatives thereof. Preferred polymers, copolymers or derivatives thereof are selected from the group consisting of: polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof.

Since the treatment compositions and unit dose articles, of the present invention, maintain their colour over longer periods of time, they can be packaged within transparent or translucent containers, while maintaining an aesthetically pleasing appearance. Translucent containers are containers having sufficient transparency, that the colour of the contained composition or unit dose articles can be seen.

A) Detergent Compositions:

The treatment composition of the present invention can be a detergent composition, preferably a laundry detergent composition. Detergent compositions comprise a surfactant, to provide a detergency benefit. The detergent compositions of the present invention may comprise from 1% to 70%, preferably from 5% to 60%, more preferably from 10% to 50%, most preferably from 15% to 45% by weight of a surfactant selected from the group consisting of: anionic, nonionic surfactants and mixtures thereof. The preferred weight ratio of anionic to nonionic surfactant is from 100:0 (i.e. no nonionic surfactant) to 5:95, more preferably from 99:1 to 1:4, most preferably from 5:1 to 1.5:1.

The detergent compositions of the present invention preferably comprise from 1 to 50%, more preferably from 5 to 40%, most preferably from 10 to 30% by weight of one or more anionic surfactants. Preferred anionic surfactant are selected from the group consisting of: C11-C18 alkyl benzene sulphonates, C10-C20 branched-chain and random alkyl sulphates, C10-C18 alkyl ethoxy sulphates, mid-chain branched alkyl sulphates, mid-chain branched alkyl alkoxy sulphates, C10-C18 alkyl alkoxy carboxylates comprising 1-5 ethoxy units, modified alkylbenzene sulphonate, C12-C20 methyl ester sulphonate, C10-C18 alpha-olefin sulphonate, C6-C20 sulphosuccinates, and mixtures thereof. However, by nature, every anionic surfactant known in the art of detergent compositions may be used, such as those disclosed in "Surfactant Science Series", Vol. 7, edited by W. M. Linfield, Marcel Dekker. The detergent compositions preferably comprise at least one sulphonic acid surfactant, such as a linear alkyl benzene sulphonic acid, or the water-soluble salt form of the acid.

The detergent compositions of the present invention preferably comprise up to 30%, more preferably from 1 to 15%, most preferably from 2 to 10% by weight of one or more nonionic surfactants. Suitable nonionic surfactants include, but are not limited to C12-C18 alkyl ethoxylates ("AE") including the so-called narrow peaked alkyl ethoxylates, C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic®-BASF Corp.), as well as semi polar nonionics (e.g., amine oxides and phosphine oxides). An extensive disclosure of suitable nonionic surfactants can be found in U.S. Pat. No. 3,929,678.

The detergent composition may also include conventional detergent ingredients selected from the group consisting of: additional surfactants such as amphoteric, zwitterionic, cationic surfactant, and mixtures thereof; enzymes; enzyme stabilizers; amphiphilic alkoxylated grease cleaning polymers; clay soil cleaning polymers; soil release polymers; soil suspending polymers; bleaching systems; optical brighteners; hueing dyes; particulate material; perfume and other odour control agents, including perfume delivery systems; hydrotropes; suds suppressors; fabric care perfumes; pH adjusting agents; dye transfer inhibiting agents; preservatives; non-fabric substantive dyes; and mixtures thereof.

B) Fabric Softening Compositions:

The treatment composition can be a fabric softening composition. Such fabric softening compositions comprise a fabric softening active ("FSA"). Suitable fabric softening actives include materials selected from the group consisting of quats, amines, fatty esters, sucrose esters, silicones, dispersible polyolefins, clays, polysaccharides, fatty oils, polymer latexes and mixtures thereof.

Suitable quats include materials selected from the group consisting of ester quats, amide quats, imidazoline quats, alkyl quats, amidoester quats and mixtures thereof. Suitable ester quats include materials selected from the group consisting of monoester quats, diester quats, triester quats and mixtures thereof. Suitable amide quats include materials selected from the group consisting of monoamide quats, diamide quats and mixtures thereof. Suitable alkyl quats include materials selected from the group consisting of mono alkyl quats, dialkyl quats, trialkyl quats, tetraalkyl quats and mixtures thereof.

Suitable amines include materials selected from the group consisting of esteramines, amidoamines, imidazoline amines, alkyl amines, amdioester amines and mixtures thereof. Suitable ester amines include materials selected from the group consisting of monoester amines, diester amines, triester amines and mixtures thereof. Suitable amido quats include materials selected from the group consisting of monoamido amines, diamido amines and mixtures thereof. Suitable alkyl amines include materials selected from the group consisting of mono alkylamines, dialkyl amines quats, trialkyl amines, and mixtures thereof.

In a preferred embodiment, the FSA is a quaternary ammonium compound. Quaternary ammonium compounds are typically formed from a reaction product of a fatty acid and an aminoalcohol, obtaining mixtures of mono-, di-, and, optionally tri-ester compounds. The FSA may comprise one or more softener quaternary ammonium compounds such as those selected from the group consisting of: a mono-alkyl quaternary ammonium compound, di-alkyl quaternary ammonium compound, a di-amido quaternary compound, a di-ester quaternary ammonium compound, and mixtures thereof. More preferably, the FSA comprises the di-ester quaternary ammonium compound (hereinafter referred to as "DQA"). Even more preferably, the FSA comprises a protonated DQA.

Examples of suitable FSAs, and compositions comprising them, can be found in US 2004/0204337 A1, US 2004/0229769 A1, and U.S. Pat. No. 6,494,920.

The fabric softening composition preferably comprises the FSA a level of at least 2%, more preferably at least about 5%, even more preferably at least about 10%, most preferably at least about 10% by weight of the composition. The fabric care composition preferably comprises the FSA of a level of less than 40%, more preferably less than 30%, most preferably less than 20%, by weight of the composition.

The fabric softening composition may comprise additional softening additives, selected from the group consisting of: polysaccharide, silicone, sucrose ester, dispersible polyolefin, polymer latex, fatty acid, softening oils, clays, and mixtures thereof.

The fabric softening composition may comprise an adjunct ingredient, such as those selected from the group consisting of: colorants, brighteners, soil release polymers, preservatives, static control agents, soil release agents, malodour control agents, fabric refreshing agents, colour maintenance agents, whiteness enhancers, anti-abrasion agents, and mixtures thereof.

Microcapsules:

The treatment composition comprises microcapsules. The microcapsules comprise a microcapsule core and a microcapsule wall that surrounds the microcapsule core. The microcapsule wall is formed by cross-linking formaldehyde with at least one other monomer. The term "microcapsule" is used herein in the broadest sense to include a core that is encapsulated by the microcapsule wall. In turn, the microcapsule core comprises a perfume. The encapsulated perfume comprises a perfume raw material selected from aldehydes, ketones, and mixtures thereof, and optionally a diluent.

Diluents are materials used to dilute the perfume that is encapsulated, and are hence preferably inert. That is, they do not react with the perfume during making or use. Preferred diluents may be selected from the group consisting of: isopropyl myristate, propylene glycol, poly(ethylene glycol), or mixtures thereof.

The microcapsules are typically formed by emulsifying the core material, comprising the perfume, into droplets and polymerizing the wall material around the droplets. As a result, the microcapsules are usually available as part of a slurry. The microcapsule slurry will typically comprise further ingredients, such as anionic emulsifiers, stabilizers such as magnesium chloride, and preservatives. Encapsulation techniques are disclosed in MICROENCAPSULATION: Methods and Industrial Applications, Edited by Benita and Simon (Marcel Dekker, Inc., 1996). Formaldehyde based resins such as melamine-formaldehyde or urea-formaldehyde resins are especially attractive for perfume encapsulation due to their wide availability and reasonable cost.

A preferred method for forming microcapsule walls is polycondensation, which may be used to produce aminoplast encapsulates. Aminoplast resins are the reaction products of one or more amine comprising monomer, with one or more aldehydes, formaldehyde being the aldehyde of choice for the present invention. The shell material surrounding the core to form the microcapsule can be formed by cross-linking the formaldehyde with at least one other monomer. While any suitable monomer may be used, the at least one other monomer is preferably selected from the group consisting of: melamine and its derivatives, urea, thiourea, glycouril, benzoguanamine, acetoguanamine, dihydroxyethyleneurea, hydroxy (alkoxy) alkyleneurea monomers, and mixtures thereof. Any suitable process can be used to form such aminoplast encapsulates. Examples of suitable processes can be found in U.S. Pat. No. 3,516,941.

The microcapsule slurry can be refined to remove polymerized wall material residues, which do not comprise any perfume, in addition to any unreacted polymer. Methods of refining the slurry include centrifugation, for instance, using a disc stack centrifuge. Suitable methods of refining the microcapsule slurry can be found in USPA 2010/0029539 A1.

The microcapsule wall may be coated with one or more materials, such as a deposition polymer, that aids in the deposition and/or retention of the microcapsule on the site that is treated with compositions comprising the microcapsules. Suitable deposition polymers are typically cationic, and can be selected from the group consisting of: polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide and mixtures thereof.

The deposition polymer typically has a weight average molecular weight of from 1,000 Da to 50,000,000 Da. The deposition polymer preferably has a charge density of from 1 meq/g of the deposition polymer to 23 meq/g of the deposition polymer.

More preferably, the deposition polymer is selected from the group consisting of polyvinyl amines, polyvinyl formamides, and polyallyl amines and copolymers thereof. Most preferably, the deposition polymer is a polyvinyl formamides. When the deposition polymer is a polyvinyl formamide, the deposition polymer preferably has a degree of hydrolysis of from 5% to 95%. Examples of suitable coatings and processes for coating microcapsules can be found in USPA 2011/0111999 (A1).

Preferably, at least 75%, 85% or even 90% of the perfume microcapsules have a particle size of from 1 microns to 80 microns, more preferably from 5 microns to 60 microns, even more preferably from 10 microns to 50 microns, most preferably from 15 microns to 40 microns.

Preferably, at least 75%, 85% or even 90% of the perfume microcapsules have a wall thickness of from 60 nm to 250 nm, more preferably from 80 nm to 180 nm, even more preferably from 100 nm to 160 nm.

In order to raise the pH of the slurry to a pH of from 4 to 7, preferably from 5 to 5.5, an alkali agent can be added. Suitable alkali agents include: sodium hydroxide, ammonia, and mixtures thereof.

The microcapsule core comprises an encapsulated perfume, the perfume comprising a perfume raw material selected from the group consisting of aldehydes, ketones, and mixtures thereof. Suitable perfume aldehydes and ketones are those that provide an odour. Perfume raw materials are odoriferous materials which enhance the smell of a treated substrate. Non-limiting examples of perfumes, suitable for encapsulation into microcapsules, are described in US 2003-0104969 A1, paragraphs 46-81. Aldehydes and ketones having an odour detection threshold (ODT) of less than 1 ppm, preferably lower than 10 ppb, are preferred. A low odour detection threshold results in lower levels of the aldehydes and ketones being needed for providing the desired scent. The microcapsule core can also comprise further perfume raw materials, depending on the desired odour character. The choice of the perfume raw materials defines both the odour intensity and character of the resultant perfume composition.

Preferably, the microcapsule core comprises from 0.1% to 100% by weight of the perfume. More preferably, the microcapsule core comprises from 10% to 50%, even more preferably from 15% to 30% by weight of the perfume.

Preferably, the perfume comprised in the microcapsule core comprises from 0.1% to 100%, more preferably from 0.5% to 75%, even more preferably from 1% to 50% by weight of the perfume raw material selected from the group consisting of: an aldehyde, a ketone, and mixtures thereof.

The perfume aldehydes and ketones, used in the slurries of the present invention, do not form complexes with urea, pyrogallol, or 1,2 hexanediol, which discolour of the slurry.

The perfume aldehyde is preferably selected from the group consisting of: Ethyl vanillin [CAS number: 121-32-4], Triplal [CAS number: 68039-49-6], Hexyl cinnamic aldehyde [CAS number: 101-86-0], Undecylenic aldehyde [CAS number: 112-45-8], Para tertiary butyl cinnamic aldehyde [CAS number: 80-54-6], Pinoacetaldehyde [CAS number:

33885-51-7], Pinyl isobutyraldehyde [CAS number: 33885-52-8], Lyral [CAS number: 31906-04-4], Hydrocintronellal [CAS number: 107-75-5], Methyl nonyl acetaldehyde [CAS number: 110-41-8], Methyl octyl acetaldehyde [CAS number: 19009-56-4], 2-[4-Methylphenyl)methylen]-heptanal [CAS number: 84697-09-6], Amyl cinnamic aldehyde [CAS number: 7493-78-9], Nonyl aldehyde [CAS number: 124-19-6], 2,6,10-trimethyl-9-undecenal [CAS number: 141-13-9], Decyl aldehyde [CAS number: 112-31-2], Lauric aldehyde [CAS number: 112-54-9], Undecylic aldehyde [CAS number: 1123-44-7], Cymal [CAS number: 103-95-7], 2,4-dimethyl-3-cyclohexen-1-carbaldehyde [CAS number: 68039-49-6], 3-(3-isopropylphenyl)butanal [CAS number: 125109-85-5], citral [CAS number: 5392-40-5], 2,6-dimethyl-5-heptenal [CAS number: 106-72-9], p-tolylacetaldehyde [CAS number: 104-09-6], Anisic aldehyde [CAS number: 123-11-5], vanillin [CAS number: 121-33-5], 2-Methyl-3-(4-methoxyphenyl)propanal [CAS number: 5462-06-6], 3-(pcumenyl)propionaldehyde [CAS number: 7775-00-0], 3-(4-ethylphenyl)-2,2-dimethylpropanal [CAS number: 67634-14-4], 3-(1,3-benzodioxol-5-yl)-2-methylpropanal [CAS number: 1205-17-0], Limonene aldehyde [CAS number: 6784-13-0], 8,8-dimethyl-2,3,4,5,6,7-hexahydro-1H-naphthalene-2-carbaldehyde [CAS number: 68991-97-9], 1-methyl-3-(4-methylpent-3-enyl)cyclohex-3-ene-1-carbaldehyde [CAS number: 52475-86-2], and mixtures thereof.

The perfume aldehyde is more preferably selected from the group consisting of: Ethyl Vanillin [CAS number: 121-32-4], Vanillin [CAS number: 121-33-5], Triplal [CAS number: 68039-49-6], Hexyl Cinnamic Aldehyde [CAS number: 101-86-0], Amyl cinnamic aldehyde [CAS number: 7493-78-9], decyl aldehyde [CAS number: 112-31-2], Cymal [CAS number: 103-95-7], Anisic aldehyde [CAS number: 123-11-5], and mixtures thereof.

The perfume ketone is preferably selected from the group consisting of: Benzyl Acetone [CAS number: 2550-26-7], Alpha-Ionone [CAS number: 12741-3], Beta-ionone [CAS number: 14901-07-6], Gamma methyl ionone [CAS number: 127-51-5], isodamascone [CAS number: 39872-57-6], Alpha-Damascone [CAS number: 24720-09-0], Beta-damascone [CAS number: 23726-91-2], Delta-damascone [CAS number: 57378-68-4], damascenone [CAS number: 23696-85-7], Methyl cedryl ketone [CAS number: 32388-55-9], dihydrojasmone [CAS number: 11128-08-1], Hexyl cyclopentanone [CAS number: 13074-65-2], 2-Heptyl cylopentanone [CAS number: 137-03-1], 2-Pentyl-cyclopentanone [CAS number: 4819-67-4], 3-methyl-2-pentyl cyclopentanone [CAS number: 13074-63-0], 2-hexylidene cyclopentanone [CAS number: 17373-86-6], 1-(5,5-Dimethyl-1-cyclohexenyl)pent-4-en-1-one [CAS number: 56973-85-4], Methyl-beta-Naphtyl ketone [CAS number: 93-08-3], Beta-Napthyl Methyl Ether [CAS number: 93-04-9], 4-Methoxy acetophenone [CAS number: 100-06-1], 4-Methyl acetophenone [CAS number: 122-06-1], Cashmeran [CAS number: 33704-61-9], 4-(4-hydroxyphenyl)-2-butanone [CAS number: 5471-51-2], Menthone [CAS number: 1074-95-9], 3,4,5,6,-pentamethyl-3-hepten-2-one [CAS number: 81786-73-4], Cis-jasmone [CAS number: 488-10-8], Methyldihydrojasmonate [CAS number: 24851-98-7], Para methyl acetophenone [CAS number: 122-00-9], 2-cyclohexyl-1,6-heptadien-3-one [CAS number: 313973-37-4], 2,4,4,7-tetramethyl-oct-6-en3-one [CAS number: 74338-72-0], Laevo Carvone [CAS number: 6485-40-1], and mixtures thereof.

The perfume ketone is more preferably selected from the group consisting of: Benzyl Acetone [CAS number: 2550-26-7], Alpha-Ionone [CAS number: 12741-3], Beta-ionone [CAS number: 14901-07-6], Gamma methyl ionone [CAS number: 127-51-5], isodamascone [CAS number: 39872-57-6], Alpha-Damascone [CAS number: 24720-09-0], Beta-damascone [CAS number: 23726-91-2], Delta-damascone [CAS number: 57378-68-4], Damascenone [CAS number: 23696-85-7], Methyl cedryl ketone [CAS number: 32388-55-9], Dihydrojasmone [CAS number: 11128-08-1], Hexyl cyclopentanone [CAS number: 13074-65-2], 2-Heptyl cylopentanone [CAS number: 137-03-1], 2-Pentyl-cyclopentanone [CAS number: 4819-67-4], 3-methyl-2-pentyl cyclopentanone [CAS number: 13074-63-0], 2-hexylidene cyclopentanone [CAS number: 17373-86-6], 1-(5,5-Dimethyl-1-cyclohexenyl)pent-4-en-1-one [CAS number: 56973-85-4], Methyl-beta-Naphtyl ketone [CAS number: 93-08-3], Beta-Napthyl Methyl Ether [CAS number: 93-04-9], Para methyl acetophenone [CAS number: 122-00-9], 2-cyclohexyl-1,6-heptadien-3-one [CAS number: 313973-37-4], 2,4,4,7-tetramethyl-oct-6-en3-one [CAS number: 74338-72-0], Laevo Carvone [CAS number: 6485-40-1], and mixtures thereof.

Particularly preferred, are perfume aldehydes and ketones selected from the group consisting of: Triplal [CAS number: 68039-49-6], Decyl Aldehyde [CAS number: 112-31-2], Cymal [CAS number: 103-95-7], Undecylenic aldehyde [CAS number: 112-45-8], delta damascone [CAS number: 57378-68-4], Gamma Methyl Ionone [CAS number: 127-51-5], and mixtures thereof.

Primary or Secondary Amine:

The treatment composition comprises at least one primary or secondary amine. Suitable primary or secondary amines may be selected from alkanolamines, polyamines, and mixtures thereof.

The term "primary or secondary amine", means a compound which carries at least one primary, or secondary amine functional moiety. Hence, primary amines comprise at least one —NH2 group, and secondary amines comprise at least on —NH—R group, wherein R is not hydrogen. The primary or secondary amine may also comprise both primary and secondary amine functional moieties. The formaldehyde scavengers of slurries of the present invention do not comprise activated methylene groups. Such activated methylene groups are able to react with primary and secondary amines, and either an aldehyde or ketone, to form complexes which lead to discoloration of the treatment composition.

Alkanolamines are typically added to treatment compositions, as a pH-adjusting agent, at a level of from 0.02% to 15%, preferably from 0.5% to 10%, more preferably from 1% to 5% by weight of the treatment composition. Suitable alkanolamines may be selected from monoalkanolamines, dialkanolamines, and mixtures thereof. Lower alkanolamines, comprising from 1 to 3 carbon atoms per alkyl group, such as monoethanolamine, diethanolamine, and mixtures thereof, are preferred. Monoethanolamine is particularly preferred. Higher alkanolamines have higher molecular weight alkyl groups, and may be less mass efficient for the purpose of pH adjustment.

The treatment composition may comprise a polyamine. When present, such polyamines are preferably present at a level of from 0.01% to 10%, preferably from 0.1% to 5%, more preferable from 0.2% to 3% by weight of the treatment composition of a polyamine.

Suitable polyamines are polymer molecules comprising at least one primary or secondary amine. Preferred polyamines have a weight average molecular weight of from 300 g/mol to 20,000,000 g/mol, preferably 500 g/mol to 10,000,000 g/mol.

Suitable polyamines comprise: at least one primary amine, at least one secondary amine, and combinations thereof, attached to a polymeric backbone. The polymeric backbone can be either inorganic, organic, and combinations thereof. Primary amine functional moieties can be: grafted to the polymer backbone, form an endcap to the polymer backbone, and combinations thereof. Secondary amine functional moieties can be: grafted to the polymer backbone, form an endcap to the polymer backbone, incorporated as part of the polymer backbone, and combinations thereof. The polymer backbone can be: linear, branched, dendritic, and combinations thereof.

Preferred polyamines, comprising an inorganic polymer backbone, are those selected from organosilicon polymers or organic-organosilicon copolymers of amino derivatized organo silane, siloxane, silazane, alumane, aluminum siloxane, or aluminum silicate compounds. More preferred polyamines, comprising an inorganic polymer backbone are: organosiloxanes with at least one primary amine moiety, such as the diaminoalkylsiloxane $[H_2NCH_2(CH_3)_2Si]O$, or the organoaminosilane $(C_6H_5)_3SiNH_2$ described in: Chemistry and Technology of Silicone, W. Noll, Academic Press Inc. 1998, London, pp 209, 106).

Preferred polyamines, utilizing an organic polymeric backbone, are those selected from: polyethyleneimines, dendrimers comprising amines; polyvinylamines and derivatives thereof, and/or copolymer thereof; polyaminoacid and copolymers thereof; cross-linked polyaminoacids; amino substituted polyvinylalcohol; polyoxyethylene bis amine or bis aminoalkyl; and mixtures thereof.

Particularly preferred polyamines are polyethyleneimines comprising at least one primary or secondary amine, such as those commercially available under the tradename Lupasol like Lupasol FG (MW 800), G20wfv (MW 1300), PR8515 (MW 2000), WF (MW 25000), FC (MW 800), G20 (MW 1300), G35 (MW 1200), G100 (MW 2000), HF (MW 25000), P (MW 750000), PS (MW 750000), SK (MW 2000000), SNA (MW 1000000). Of these, the most preferred include Lupasol HF or WF (MW 25000), P (MW 750000), PS (MW 750000), SK (MW 2000000), 620wfv (MW 1300) and PR 1815 (MW 2000), Epomin SP-103, Epomin SP-110, Epomin SP-003, Epomin SP-006, Epomin SP-012, Epomin SP-018, Epomin SP-200, and partially alkoxylated polyethyleneimine, such as polyethyleneimine 80% ethoxylated from Aldrich.

Also preferred are dendrimers selected from the group consisting of: polyethyleneimine dendrimers; polypropyleneimine dendrimers; polyamidoamine dendrimers; and mixtures thereof. Commercial polyamidoamines (PAMAM) dendrimers are available under the tradenames: Starburst®, generation G0-G10 from Dendritech, and the Astromols® dendrimers generation 1-5 from DSM (being DiAminoButane PolyAmine DAB $(PA)_x$ dendrimers with $x=2^n$)(4 and n being generally comprised between 0 and 4).

Suitable polyamines can also be selected from the group consisting of: polyvinylamine with a weight average MW of from 300 to 2,000,000; alkoxylated polyvinylamine with a weight average MW of from 600 to 3000 and a degree of ethoxylation of from 0.2 to 0.8; polyvinylamine vinylalcohol—molar ratio 2:1, polyvinylamine vinylformamide—molar ratio 1:2 and polyvinylamine vinylformamide-molar ratio 2:1; triethylenetetramine; diethylenetriamine; tetraethylenepentamine; bis-aminopropylpiperazine; polyamino acid (L-lysine/lauric acid in a molar ratio of 10/1); polyamino acid (L-lysine/aminocaproic acid/adipic acid in a molar ratio of 5/5/1); polyamino acid (L-lysine/aminocaproic acid/ethylhexanoic acid in a molar ratio of 5/3/1); polyamino acid (polylysine-cocaprolactam); polylysine; polylysine hydrobromide; cross-linked polylysine; amino substituted polyvinylalcohol with a weight average MW of from 400 to 300,000; polyoxyethylene bis[amine]; polyoxyethylene bis[6-aminohexyl]; N,N'-bis-(3-aminopropyl)-1,3-propanediamine linear or branched (TPTA); and 1,4-bis-(3-aminopropyl) piperazine (BNPP).

The more preferred primary or secondary amines are selected from: alkanolamines, ethyl-4-amino benzoate, polyethyleneimine polymers commercially available under the tradename Lupasol, such as Lupasol HF, P, PS, SK, SNA, WF, G20wfv and PR8515; the diaminobutane dendrimers Astramol®, polylysine, cross-linked polylysine, N,N'-bis-(3-aminopropyl)-1,3-propanediamine linear or branched; 1,4-bis-(3-aminopropyl) piperazine, and mixtures thereof. Most preferred primary or secondary amines are those selected from: alkanolamines, ethyl-4-amino benzoate, polyethyleneimine polymers having a molecular weight greater than 200 Daltons, including those commercially available under the tradename Lupasol such as Lupasol HF, P, PS, SK, SNA, WF, G20wfv and PR8515; polylysine; cross-linked polylysine; N,N'-bis-(3-aminopropyl)-1,3-propanediamine, linear or branched; 1,4-bis-(3-aminopropyl) piperazine; and mixtures thereof.

Formaldehyde Scavenger:

The microcapsules of the treatment composition, of the present invention, comprise a wall that is made by cross-linking formaldehyde with at least one other monomer. After the cross-linking reaction has been completed, residual amounts of free formaldehyde remain. Further formaldehyde can be introduced with additional ingredients, such as cross-linking agents. In addition, formaldehyde is released as the microcapsules age. Without wishing to be bound by theory, it is believed that the free formaldehyde levels increase due to residual curing, and hydrolysis of the end-groups, in the cross-linked microcapsule wall. Therefore, a formaldehyde scavenger is added to the treatment composition, to ensure the level of free formaldehyde remains at acceptable levels.

The term "free formaldehyde" means those molecular forms present in aqueous solution capable of rapid equilibration with the native molecule, i.e., $H_2CO$, in the headspace over the solution. This includes the aqueous native molecule, its hydrated form (methylene glycol $HOCH_2OH$), and its polymerized hydrated form $(HO(CH2O)_nH$, wherein n is greater than 1. These are described in detail in a monograph by J. F. Walker (Formaldehyde ACS Monograph Series No. 159 3rd Edition 1964 Reinhold Publishing Corp.). The free formaldehyde level is measured using ASTM method D5910-05.

The treatment compositions of the present invention comprise a formaldehyde scavenger selected from the group consisting of: urea, pyrogallol, 1,2 hexanediol, and mixtures thereof. Derivatives of the aforementioned formaldehyde scavengers are not considered suitable for use in the treatment compositions of the present invention.

a)

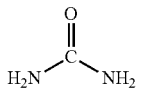

Urea

-continued b)

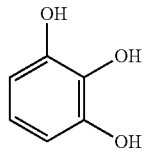

pyrogallol c)

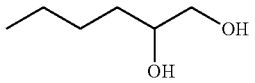

1,2 hexanediol

The formaldehyde scavenger can be added directly to the treatment composition, or as part of a premix. However, the formaldehyde scavenger is preferably incorporated into the microcapsule slurry which is, in turn, incorporated into the treatment composition. When the formaldehyde scavenger is added via the microcapsule slurry, it has been found that the colour stability of the treatment composition is further enhanced.

The formaldehyde scavengers of the present invention do not comprise activated methylene groups. Activated methylene groups have a methylene group between two strong electron withdrawing groups. Without wishing to be bound by theory, it is believed that activated methylene groups can react with aldehydes and ketones, resulting in coloured compounds which discolour the treatment composition. The treatment composition may comprise further formaldehyde scavengers. However, such further formaldehyde scavengers should also not comprise an activated methylene group. When present, the amount of formaldehyde scavenger comprising an activated methylene group, which is present in the treatment composition, is limited to less than 25%, more preferably less than 15%, most preferably less than 5% of the total level of formaldehyde scavenger.

Urea is the most preferred formaldehyde scavenger. It is believed that as well as being a formaldehyde scavenger, urea is able to undergo a cross-linking reaction with the polymeric wall of the microcapsules, and inhibit the release of free formaldehyde from the microcapsule wall. Hence, it is believed that urea can both reduce the generation of free formaldehyde, and scavenge any formaldehyde that is released into the slurry or treatment composition. For instance, when the microcapsule wall is formed by cross-linking formaldehyde with melamine, it is believed that urea is able to react with the methylol groups of the melamine-formaldehyde polymeric wall, and inhibits the release of free formaldehyde from the microcapsule wall. Moreover, when the urea complexes with the microcapsule wall, particularly walls made from crosslinking urea, melamine, and mixtures thereof with formaldehyde, the wall is made less porous. As a consequence, leakage of the perfume raw materials from the microcapsule core, including aldehydes and ketones, is reduced. When urea is used, the urea is preferably added directly to the microcapsule slurry, which is in turn added to the treatment composition. When urea is first added to the microcapsule slurry, which is then added to the treatment composition, a pH of less than 5.5 is particularly preferred for the microcapsule slurry, for improved formaldehyde scavenging and microcapsule wall stability.

The formaldehyde scavenger is preferably added to the treatment composition, in an excess amount relative to the free formaldehyde that would be present if no formaldehyde scavenger had been added. As such, the formaldehyde scavenger is preferably added at excess molar concentrations of from 1:1 to 5:1, more preferably from 2:1 to 4:1, even more preferably from 2:1 to 5:2, most preferably from 5:2 to 5:1, relative to the amount of free formaldehyde that would be present in the treatment composition if no formaldehyde scavenger were added. The amount of free formaldehyde, that would be present in the treatment composition, is determined in the absence of the formaldehyde scavenger.

The formaldehyde scavenger is preferably present at a level which reduces free formaldehyde in the treatment composition to less than 50 parts per million (ppm), more preferably to less than about 25 ppm, even more preferably to less than about 10 ppm. When the formaldehyde scavenger is added directly to the microcapsule slurry, the formaldehyde scavenger is preferably present at a level which reduces free formaldehyde in the treatment composition to less than 50 parts per million (ppm), more preferably to less than about 25 ppm, even more preferably to less than about 10 ppm.

The formaldehyde scavenger is preferably present in the treatment composition at a level of from 0.005% to 0.8%, more preferably from 0.03% to 0.5%, most preferably from 0.065% to 0.25%, by weight of the treatment composition.

If added directly to the microcapsule slurry, the formaldehyde scavenger is preferably present in the microcapsule slurry at a level of from 0.01% to 12%, more preferably from 1% to 8%, most preferably from 2% to 6%, by weight of the microcapsule slurry.

Method of Treatment:

The compositions of the present invention can be used in a method of providing an extended odour benefit to a situs, by contacting the situs with the treatment composition of the present invention. Typically, the extended odour benefit is the provision of a perfume odour benefit, upon rubbing the dried situs, after the fabric has been stored on a shelf for 1 week, preferably 2 weeks, more preferably 4 weeks at 25° C., and wrapped in aluminium foil.

Preferably, the situs is a fabric. The fabric is preferably contacted with the treatment composition in an automatic washing machine. For instance, when the treatment composition is a detergent composition, the fabric is contacted with the treatment composition during the wash cycle of the automatic washing machine. When the treatment composition is a fabric softening composition, the fabric is contacted with the treatment composition during a rinse cycle of the automatic washing machine.

Methods:

A) pH Measurement:

The pH is measured on the neat composition, at 25° C., using a Sartarius PT-10P pH meter with gel-filled probe (such as the Toledo probe, part number 52 000 100), calibrated according to the instructions manual.

B) Odour Detection Threshold:

The odour detection threshold is measured at controlled Gas Chromatography (GC) conditions such as described here below. This parameter refers to the value commonly used in the perfumery arts and which is the lowest concentration at which significant detection takes place that some odorous material is present. Please refer for example in "Compilation of Odor and Taste Threshold Value Data (ASTM DS 48 A)", edited by F. A. Fazzalari, International Business Machines, Hopwell Junction, N.Y. and in Calkin et al., Perfumery, Practice and Principles, John Willey & Sons, Inc., page 243 et seq (1994). For the purpose of the present invention, the odour Detection Threshold is measured according to the following method:

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.02 minutes, the sampled volume is calculated. Since the precise concentration at the detector at any point in time is known, the mass per volume inhaled is known and hence the concentration of material. To determine the ODT of a perfume material, solutions are delivered to the sniff port at the back-calculated concentration. A panellist sniffs the GC effluent and identifies the retention time when odour is noticed. The average over all panellists determines the threshold of noticeability. The necessary amount of analyte is injected onto the column to achieve a certain concentration, such as 10 ppb, at the detector. Typical gas chromatograph parameters for determining odour detection thresholds are listed below:

GC: 5890 Series II with FID detector
7673 Autosampler
Column: J&W Scientific DB-1
Length 30 meters ID 0.25 mm film thickness 1 micron
Method:
Split Injection: 17/1 split ratio
Autosampler: 1.13 microliters per injection
Column Flow: 1.10 mL/minute
Air Flow: 345 mL/minute
Inlet Temp. 245° C.
Detector Temp. 285° C.
Temperature Information
Initial Temperature: 50° C.
Rate: 5 C/minute
Final Temperature: 280° C.
Final Time: 6 minutes
Leading assumptions: 0.02 minutes per sniff
GC air adds to sample dilution

EXAMPLES

Two slurries of perfume containing microcapsules were prepared, slurry A, of use in treatment compositions of the present invention, and slurry B, of use in comparative treatment compositions. The slurries were made using the same procedure, except that slurry A comprised 4 wt % urea as the formaldehyde scavenger, and slurry B comprised 1.4 wt % acetoacetamide as the formaldehyde scavenger. Both slurries comprised microcapsules of the same composition and structure. The microcapsules of both slurries comprised walls that were formed by cross-linking melamine with formaldehyde. The microcapsules of both slurries were coated with polyvinyl formamide. The core of the microcapsules of both slurries consisted of the same perfume, comprising 39.2 wt % of aldehydes.

| | Slurry A (of use in compositions of the present invention) wt % in slurry | Slurry B (comparative) wt % in slurry |
|---|---|---|
| Encapsulated perfume[1] | 34 | 34 |
| Urea | 4 | — |
| Acetoacetamide | — | 1.4 |
| pH of slurry | 5.3 | 5.3 |
| Free formaldehyde level | <50 ppm | <50 ppm |

[1]The encapsulated perfume comprised 39.2 wt % of aldehydes

The slurries were incorporated into laundry treatment compositions, to form the following finished treatment compositions. Treatment composition A comprised 0.035 wt % of urea. Treatment composition B (comparative) comprised 0.01 wt % of acetoacetamide. Both treatment compositions exhibited free formaldehyde levels of less than 1 ppm:

| Ingredient | Treatment composition A wt % | Treatment composition B (comparative) wt % |
|---|---|---|
| Alkylbenzene sulphonic acid | 3.2 | 3.2 |
| Sodium C12-15 alkyl sulphate | 4 | 4 |
| Sodium C12-15 alkyl ethoxy 1.8 sulphate | 10.3 | 10.3 |
| C12-14 alkyl 9-ethoxylate | 0.66 | 0.66 |
| C12-C14 alkyl dimethyl amine oxide | 0.9 | 0.9 |
| C12-18 Fatty acid | 1.5 | 1.5 |
| Citric acid | 1.8 | 1.8 |
| Protease (Purafect Prime ®, 40.6 mg active/g) | 1.3 | 1.3 |
| Amylase (Natalase ®, 29.26 mg active/g) | 0.3 | 0.3 |
| Diethylenetriamine penta carboxylic acid | 0.5 | 0.5 |
| Brightener[2] | 0.16 | 0.16 |
| Borax | 2.5 | 2.5 |
| Polyethylenimine$_{600}$(EO)$_{24}$(PO)$_{16}$[3] | 0.83 | 0.83 |
| Ethoxylated polyethylenimine[4] | 1.8 | 1.8 |
| Solvents (1,2 propanediol, ethanol), stabilizers | 7.1 | 7.1 |
| Sodium formate | 0.2 | 0.2 |
| Hydrogenated castor oil derivative structurant | 0.14 | 0.14 |
| Unencapsulated perfume[5] | 0.63 | 0.63 |
| Slurry A | 0.88 | — |
| Slurry B (comparative) | — | 0.88 |
| Blue dye | 0.015 | 0.015 |
| Monoethanolamine | 1.4 | 1.4 |
| Water and minors | Up to 100 | Up to 100 |
| NaOH, sufficient to provide formulation pH of: | 8.2 | 8.2 |
| Free formaldehyde level | <1 ppm | <1 ppm |

[2]Tinopal ® TAS-X B36
[3]Sokalan PG 640from BASF
[4]Polyethyleneimine (MW = 600) with 20 ethoxylate groups per —NH
[5]The unencapsulated perfume comprised 17.8 wt % of aldehydes and ketones 200 ml of treatment compositions A and B (comparative) were sealed in 375 ml glass jars, and the treatment compositions aged for 2 weeks at 50° C. and 8 weeks at 35° C. The composition colour, before and after aging, and the change in colour (ΔE) were measured using the following procedure:

A plastic cuvette (size 12.5×12.5×45 mm, made by BRAND, Cat No 7590 05) was filled with the treatment composition to be analysed, ensuring that the sample was free of bubbles. The color was measured with a Hunterlab Color Quest XE, with the measurement done in Reflectance mode, under D65/10 light conditions, and a 9.5 mm aperture. The colour was measured on the L a b scale for both the "fresh" treatment composition (measured 1 hour after making and store at 21° C.), and the aged treatment compositions. The discoloration, expressed as the change in colour ΔE, was calculated from the L a b values using the following equation: $\Delta E=(\Delta L^2+\Delta a^2+\Delta b^2)^{1/2}$:

| Ingredient | Treatment composition A ΔE | Treatment composition B (comparative) ΔE |
|---|---|---|
| 2 weeks at 50° C. | 2.1 | 10.9 |
| 8 weeks at 35° C. | 7.8 | 11.7 |

As can be seen from the colour stability data, the discoloration was substantially less for treatment composition A, using urea as the formaldehyde scavenger, even though a much higher level of the formaldehyde scavenger was used, in comparison to the acetoacetamide formaldehyde scavenger of comparative treatment composition B.

Examples C to H

Liquid Laundry Treatment Compositions

Non-limiting examples of treatment compositions, of the present invention, comprising microcapsules having a microcapsule wall, formed from cross-linking melamine and formaldehyde, and a core comprising an aldehyde or ketone containing perfume, and a formaldehyde scavenger selected from urea, pyrogallol, and 1,2 hexanediol are disclosed in the table below:

| Ingredient | C wt % | D wt % | E wt % | F wt % | G wt % | H wt % |
|---|---|---|---|---|---|---|
| Sodium C12-15 alkyl ethoxy 1.8 sulphate | — | 0.50 | 12.0 | 12.0 | 6.0 | 7.0 |
| Dodecyl Benzene Sulphonic Acid | 8.0 | 8.0 | 1.0 | 1.0 | 2.0 | 3.0 |
| C12-14 alkyl 9-ethoxylate | 8.0 | 6.0 | 5.0 | 7.0 | 5.0 | 3.0 |
| Citric Acid | 5.0 | 3.0 | 3.0 | 5.0 | 2.0 | 3.0 |
| C12-18 Fatty acid | 3.0 | 5.0 | 5.0 | 3.0 | 6.0 | 5.0 |
| Ethoxy sulphated hexamethylene diamine quaternized | 1.9 | 1.2 | 1.5 | 2.0 | 1.0 | 1.0 |
| Diethylene triamine penta methylene phosphonic acid | 0.3 | 0.2 | 0.2 | 0.3 | 0.1 | 0.2 |
| Enzymes[6] | 1.20 | 0.80 | — | 1.2 | 0 | 0.8 |
| Fluorescent brightener[7] | 0.14 | 0.09 | — | 0.14 | 0.01 | 0.09 |
| Cationic hydroxyethyl cellulose | — | — | 0.10 | — | 0.200 | 0.30 |
| Poly(acrylamide-co-diallyldimethylammonium chloride) | — | — | 0 | 0.50 | 0.10 | — |
| Hydrogenated Castor Oil Structurant | 0.50 | 0.44 | 0.2 | 0.2 | 0.3 | 0.3 |
| Boric acid | 2.4 | 1.5 | 1.0 | 2.4 | 1.0 | 1.5 |
| Ethanol | 0.50 | 1.0 | 2.0 | 2.0 | 1.0 | 1.0 |
| 1,2 propanediol | 2.0 | 3.0 | 1.0 | 1.0 | 0.01 | 0.01 |
| Diethyleneglycol (DEG) | 1.6 | — | — | — | — | — |
| 2,3-Methyl-1,3-propanediol (Mpdiol) | 1.0 | 1.0 | — | — | — | — |
| Monoethanolamine | 1.0 | 0.5 | — | — | — | — |
| NaOH, sufficient to provide formulation pH of: | pH 8 | pH 8 | pH 8 | pH 8 | pH 8 | pH 8 |
| Sodium Cumene Sulphonate (NaCS) | 2.00 | — | — | — | — | — |
| Silicone (PDMS) emulsion | 0.003 | 0.003 | 0.003 | 0.003 | 0.003 | 0.003 |
| Unencapsulated perfume | 0.7 | 0.5 | 0.8 | 0.8 | 0.6 | 0.6 |
| Polyethylenimine $_{600}(EO)_{24}(PO)_{16}$[3] | 0.01 | 0.10 | 0.00 | 0.10 | 0.20 | 0.05 |
| Perfume Microcapsules slurry[8] | 1.00 | 5.00 | 1.00 | 2.00 | 0.10 | 0.80 |
| Urea[9] | 0.06 | 0.2 | — | — | — | — |
| Pyrogallol[9] | — | — | 0.05 | 0.14 | — | — |
| 1,2 hexanediol[9] | — | — | — | — | 0.005 | 0.056 |
| Water | Balance to 100% | Balance to 100% | Balance to 100% | Balance to 100% | Balance to 100% | Balance to 100% |

[6]Natalase ®, Mannaway ® and Whitezyme ®, all products of Novozymes, Bagsvaerd, Denmark.

[7]Fluorescent brightener can be anyone of Tinopa ® AMS-GX, Tinopal ® CBS-X or Tinopal ® TAS-X B36, or mixtures thereof, all supplied by Ciba Specialty Chemicals, Basel, Switzerland

[8]A perfume microcapsule slurry comprising 35 wt % of microcapsules, the microcapsules having a wall formed from cross-linking melamine and formaldehyde, and comprising an aldehyde or ketone containing perfume.

[9]Added either directly to the liquid laundry treatment composition, or to the microcapsule slurry, which is in turn, added to the treatment composition.

Non-limiting examples of low water treatment compositions, of the present invention, comprising the aforementioned microcapsules, and urea as a formaldehyde scavenger are disclosed in the table below:

| Ingredient | Treatment composition I wt % | Treatment composition J wt % | Treatment composition K wt % |
|---|---|---|---|
| Linear Alkylbenzene sulfonic acid | 15 | 17 | 19 |
| C12-14 alkyl ethoxy 3 sulfonic acid | 7 | 8 | — |
| C12-15 alkyl ethoxy 2 sulfonic acid | — | — | 9 |
| C14-15 alkyl 7-ethoxylate | — | 14 | — |
| C12-14 alkyl 7-ethoxylate | 12 | — | — |
| C12-14 alkyl-9-ethoxylate | — | — | 15 |
| C12-18 Fatty acid | 15 | 17 | 5 |
| Citric acid | 0.7 | 0.5 | 0.8 |
| Ethoxylated polyethylenimine[4] | 4 | — | 7 |
| Hydroxyethane diphosphonic acid | 1.2 | — | — |
| Diethylenetriamine Pentaacetic acid | — | — | 0.6 |
| Ethylenediaminediscuccinic acid | — | — | 0.6 |
| Fluorescent Whitening Agent | 0.2 | 0.4 | 0.2 |
| 1,2 Propanediol | 16 | 12 | 14 |
| Glycerol | 6 | 8 | 5 |
| Diethyleneglycol | — | — | 2 |
| Hydrogenated castor oil (structurant) | 0.15 | 0.25 | — |
| Unencapsulated perfume | 2.0 | 1.5 | 1.7 |

-continued

| Ingredient | Treatment composition I wt % | Treatment composition J wt % | Treatment composition K wt % |
|---|---|---|---|
| Perfume Microcapsules slurry[8] | 0.3 | 1.4 | 8 |
| Urea[9] | 0.012 | 0.084 | 0.64 |
| Monoethanolamine | Up to pH 8 | Up to pH 8 | Up to pH 8 |
| Protease enzyme[6] | 0.05 | 0.075 | 0.12 |
| Amylase enzyme | 0.005 | — | 0.01 |
| Mannanase enzyme[6] | 0.01 | — | 0.005 |
| Xyloglucanase | — | — | 0.005 |
| Water | 10 | 8 | 9 |
| Minors (antifoam, aesthetics, stabilizers etc.) | To 100 parts | To 100 parts | To 100 parts |

The resultant low water treatment compositions can be encapsulated in water-soluble film, to form water-soluble unit-dose articles.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A treatment composition comprising:

(a) microcapsules, the microcapsules comprising a microcapsule core and a microcapsule wall which encapsulates the microcapsule core, wherein (i) the microcapsule wall is formed by cross-linking formaldehyde with at least one other monomer; and (ii) the microcapsule core comprises a perfume, the perfume comprising a perfume raw material selected from the group consisting of aldehydes, ketones, and mixtures thereof;

(b) a primary or secondary amine;

(c) a formaldehyde scavenger consisting of urea, wherein the formaldehyde scavenger is present in the treatment composition at a level of from 0.035% to 0.8% by weight of the treatment composition;

(d) a non-fabric substantive dye, wherein the non-fabric substantive dye comprises blue dye.

2. The treatment composition according to claim 1, wherein the at least one other monomer of the microcapsule wall is selected from the group consisting of: melamine, urea, glycouril, benzoguanine, dihydroxyethyleneurea, hydroxy (alkoxy) alkyleneurea monomers, and mixtures thereof.

3. The treatment composition according to claim 1, wherein the treatment composition comprises the microcapsules at a level of from about 0.01 wt % to about 12.5 wt % by weight of the treatment composition.

4. The treatment composition according to claim 1, wherein the perfume comprised in the microcapsule core comprises from 0.1% to 100% by weight of the perfume raw material selected from the group consisting of: an aldehyde, a ketone, and mixtures thereof.

5. The treatment composition according to claim 1, wherein the perfume raw material selected from:

(a) a perfume aldehyde selected from the group consisting of: Ethyl vanillin [CAS number: 121-32-4], Triplal [CAS number: 68039-49-6], Hexyl cinnamic aldehyde [CAS number: 101-86-0], Undecylenic aldehyde [CAS number: 112-45-8], Para tertiary butyl cinnamic aldehyde [CAS number: 80-54-6], Pinoacetaldehyde [CAS number: 33885-51-7], Pinyl isobutyraldehyde [CAS number: 33885-52-8], Lyral [CAS number: 31906-04-4], Hydrocintronellal [CAS number: 107-75-5], Methyl nonyl acetaldehyde [CAS number: 110-41-8], Methyl octyl acetaldehyde [CAS number: 19009-56-4], 2-[4-Methylphenyl)methylen]-heptanal [CAS number: 84697-09-6], Amyl cinnamic aldehyde [CAS number: 7493-78-9], Nonyl aldehyde [CAS number: 124-19-6], 2,6,10-trimethyl-9-undecenal [CAS number: 141-13-9], Decyl aldehyde [CAS number: 112-31-2], Lauric aldehyde [CAS number: 112-54-9], Undecylic aldehyde [CAS number: 1123-44-7], Cymal [CAS number: 103-95-7], 2,4-dimethyl-3-cyclohexen-1-carbaldehyde [CAS number: 68039-49-6], 3-(3-isopropylphenyl)butanal [CAS number: 125109-85-5], citral [CAS number: 5392-40-5], 2,6-dimethyl-5-heptenal [CAS number: 106-72-9], p-tolylacetaldehyde [CAS number: 104-09-6], Anisic aldehyde [CAS number: 123-11-5], vanillin [CAS number: 121-33-5], 2-Methyl-3-(4-methoxyphenyl)propanal [CAS number: 5462-06-6], 3-(pcumenyl) propionaldehyde [CAS number: 7775-00-0], 3-(4-ethylphenyl)-2,2-dimethylpropanal [CAS number: 67634-14-4], 3-(1,3-benzodioxol-5-yl)-2-methylpropanal [CAS number: 1205-17-0], Limonene aldehyde [CAS number: 6784-13-0], 8,8-dimethyl-2,3,4,5,6,7-hexahydro-1H-naphthalene-2-carbaldehyde [CAS number: 68991-97-9], 1-methyl-3-(4-methylpent-3-enyl)cyclohex-3-ene-1-carbaldehyde [CAS number: 52475-86-2], and mixtures thereof;

(b) a perfume ketone selected from the group consisting of: Benzyl Acetone [CAS number: 2550-26-7], Alpha-Ionone [CAS number: 12741-3], Beta-ionone [CAS number: 14901-07-6], Gamma methyl ionone [CAS number: 127-51-5], isodamascone [CAS number: 39872-57-6], Alpha-Damascone [CAS number: 24720-09-0], Beta-damascone [CAS number: 23726-91-2], Delta-damascone [CAS number: 57378-68-4], Damascenone [CAS number: 23696-85-7], Methyl cedryl ketone [CAS number: 32388-55-9], Dihydrojasmone [CAS number: 11128-08-1], Hexyl cyclopentanone [CAS number: 13074-65-2], 2-Heptyl cylopentanone [CAS number: 137-03-1], 2-Pentyl-cyclopentanone [CAS number: 4819-67-4], 3-methyl-2-pentyl cyclopentanone [CAS number: 13074-63-0], 2-hexylidene cyclopentanone [CAS number: 17373-86-6], 1-(5,5-Dimethyl-1-cyclohexenyl)pent-4-en-1-one [CAS number: 56973-85-4], Methyl-beta-Naphtyl ketone [CAS number: 93-08-3], Beta-Napthyl Methyl Ether [CAS number: 93-04-9], 4-Methoxy acetophenone [CAS number: 100-06-1], 4-Methyl acetophenone [CAS number: 122-06-1], Cashmeran [CAS number: 33704-61-9], 4-(4-hydroxyphenyl)-2-butanone [CAS number: 5471-51-2], Menthone [CAS number: 1074-95-9], 3,4,5,6,-pentamethyl-3-hepten-2-one [CAS number: 81786-73-4], Cis-jasmone [CAS number: 488-10-8], Methyldihydrojasmonate [CAS number: 24851-98-7], Para methyl acetophenone [CAS number: 122-00-9], 2-cyclohexyl-1,6-heptadien-3-one [CAS number: 313973-37-4], 2,4,4,7-tetramethyl-oct-6-en3-one [CAS number: 74338-72-0], Laevo Carvone [CAS number: 6485-40-1], and mixtures thereof; and (c) mixtures thereof.

6. The treatment composition according to claim 1, wherein the treatment composition is a fabric treatment composition selected from the group consisting of: laundry detergent composition, fabric softening composition, and combinations thereof.

7. The treatment composition according to claim 1, wherein the treatment composition further comprises an unencapsulated perfume composition.

8. The treatment composition according to claim 7, wherein the unencapsulated perfume composition comprises a perfume raw material selected from the group consisting of: an aldehyde, a ketone, and mixtures thereof.

9. The treatment composition according to claim 1, wherein the treatment composition further comprises a polyamine.

10. A packaged product comprising the treatment composition according to claim 1, contained within a transparent or translucent container.

11. A method of providing an extended odour benefit to a situs, comprising the step of contacting the situs with a treatment composition according to claim 1.

12. A method according to claim 11, wherein the situs is a fabric, and the fabric is optionally contacted with the treatment composition in an automatic washing machine.

13. A treatment composition according to claim 1, wherein the composition comprises the formaldehyde scavenger at excess molar concentrations of from 1:1 to 5:1, relative to the amount of free formaldehyde that would be present in the treatment composition if no formaldehyde scavenger were added.

14. A treatment composition according to claim 1, wherein said primary or secondary amine comprises a polyethyleneimine.

15. A unit dose article, comprising a treatment composition according to claim 1, wherein the treatment composition comprises less than 20% by weight of water, and the treatment composition is enclosed in a water-soluble or dispersible film.

16. A packaged product comprising the unit dose article according to claim 15, contained within a transparent or translucent container.

17. A method for preventing discoloration in a treatment composition comprising microcapsules, comprising the steps of:

a) providing a composition comprising microcapsules, the microcapsules comprising a microcapsule core and a microcapsule wall which encapsulates the microcapsule core, wherein:

(i) the microcapsule wall is formed by cross-linking formaldehyde with at least one other monomer; and (ii) the microcapsule core comprises a perfume, the perfume comprising a perfume raw material selected from the group consisting of aldehydes, ketones, and mixtures thereof; and b) combining the composition with a formaldehyde scavenger consisting of urea, thereby forming a treatment composition, wherein the formaldehyde scavenger is present in the treatment composition at a level of from 0.035% to 0.8% by weight of the treatment composition; wherein the treatment composition further comprises a non-fabric substantive dye that comprises blue dye.

* * * * *